US007044793B2

(12) United States Patent
Takemasa

(10) Patent No.: US 7,044,793 B2
(45) Date of Patent: May 16, 2006

(54) CONNECTOR ASSEMBLY

(75) Inventor: Eiichiro Takemasa, Kanagawa (JP)

(73) Assignee: Tyco Electronics AMP K.K., Kanagawa (JP)

( * ) Notice: Subject to any disclaimer, the term of this patent is extended or adjusted under 35 U.S.C. 154(b) by 0 days.

(21) Appl. No.: 10/847,039

(22) Filed: May 17, 2004

(65) Prior Publication Data

US 2004/0235352 A1 Nov. 25, 2004

(30) Foreign Application Priority Data

May 22, 2003 (JP) ..... 2003-145181

(51) Int. Cl.
*H01R 13/648* (2006.01)

(52) U.S. Cl. ..... 439/608; 439/638

(58) Field of Classification Search ..... 439/608, 439/607, 609–610, 108, 701, 939, 941, 638; 361/637, 639; 174/68.2
See application file for complete search history.

(56) References Cited

U.S. PATENT DOCUMENTS 6,171,115 B1 1/2001 Mickievicz et al.
6,384,341 B1 5/2002 Rothermel et al.
6,443,740 B1 * 9/2002 Evans ..... 439/63
6,500,029 B1 * 12/2002 Nitta ..... 439/608
6,621,391 B1 * 9/2003 Freeman ..... 335/78
6,692,272 B1 * 2/2004 Lemke et al. ..... 439/108
6,693,370 B1 * 2/2004 Yamane et al. ..... 307/10.1
6,712,646 B1 * 3/2004 Shindo ..... 439/608

FOREIGN PATENT DOCUMENTS

JP 05-021119 2/1993

* cited by examiner

*Primary Examiner*—J. F. Duverne
(74) *Attorney, Agent, or Firm*—Barley Snyder LLC

(57) ABSTRACT

The present invention provides a connector assembly which allows the easy replacement of easily damaged female contacts, and which can be used in data transfer systems such as communications devices that transmit data signals at a high speed. The connector assembly comprises a first connector having a plurality of first boards which have conductors formed on the surfaces thereof, a second connector having a plurality of second boards which have conductors formed on the surfaces thereof, and a relay connector which is attached to the first connector or second connector. A plurality of female contacts having first female contact portions that contact the conductors of the first boards and second female contact portions that contact the conductors of the second boards are press-fitted in the relay connector.

14 Claims, 10 Drawing Sheets

CONNECTOR ASSEMBLY

FIELD OF THE INVENTION

The present invention relates to a connector assembly used in data transfer systems such as communications devices that transmit data signals at a high speed.

BACKGROUND OF THE INVENTION

In connectors used in high speed data transfer systems, such as communications devices that transmit data signals at speeds exceeding 2 Gbps, the impedance of the signal paths inside the connector must be maintained at a uniform value.

An exemplary connector 101 that is used to maintain a uniform impedance is shown in FIGS. 8 and 9. This connector 101 comprises an insulating housing 110 and a plurality of boards 120 that are supported in a row in the housing 110. Each board 120 is constructed from an insulating board material such as FR4, and a pattern comprising a plurality of signal conductors 121 and a plurality of ground conductors 122 is formed such that the ground conductors surround the signal conductors 121 with a specified distance retained between the respective conductors. The pattern of signal and ground conductors is disposed on the front and back surfaces of each board 120. The signal conductors 121 extend from a first side 123 of the board 20 configured to mate with a mating connector (not shown in the figures) to a second side 124 of the board 120 with mounting pads 124 thereon and configured to be connected to another circuit board (not shown in the figures). The ground conductors 122 extend from points located slightly to the inside of the contacts on the first side 123 to the mounting pads on the second side 124. A plurality of contacts 130 are disposed on the mounting pads at the second side 124 of the respective boards 120 to form an electrical connection to the signal conductors 121 and ground conductors 122.

The housing 110 comprises a front housing portion 111 and an accommodating body 114. The front housing portion 111 comprises a vertical wall 111*a* and a top 11*b* that extends rearward (to the left in FIG. 8) from an upper end of the vertical wall 111*a*. A plurality of slits 112 pass through the vertical wall 111*a* such that the contacts 123 of the respective boards 120 are passed through the slits 112. Grooves 113*a* and 113*b* are respectively formed in protruding wall that extends forward from the lower end of the vertical wall 111*a* and from the upper end of the vertical wall 111*a* into which the lower ends and upper ends of the respective boards 120 are inserted. Furthermore, the accommodating body 114 comprises a platform portion 114*a* that extends in the forward-rearward direction, and a rear vertical wall 114*b* that extends upward from the rear end of the platform portion 114*a*. A plurality of grooves 115 are formed in the platform part 114*a* to receive the second side 124 of the respective boards 120 having the mounting pads disposed thereon. A through-hole (not shown in the figures) is formed in each groove 115, through which one of the contacts 130 connected to the signal conductors 121 and ground conductors 122 is passed. Furthermore, a plurality of grooves 116 are formed in the rear vertical wall 114*b*, into which the contacts on the first side 123 of the respective boards 120 are inserted. Moreover, engaging posts 117 that engage with the top portion 111*b* of the front housing portion 111 are formed on the upper end surface of the rear vertical wall 114*b*.

In the connector 101 shown in FIGS. 8 and 9, the contacts on the signal conductors 121 of the respective boards 120 at the first side 123 thereof are utilized as male type contacts, and are mated and connected with female type contacts (not shown in the figures) disposed on the side of the mating connector. The plurality of contacts 130 disposed on the mounting pads at the second side 124 of the respective boards 120 are connected to the circuit board. As a result, the impedance of the signal paths inside the connector 101 can be maintained at a uniform value, so that data signals can be transmitted at a high speed.

FIG. 10 shows a configuration in which multi-layer boards 301 and 302 are connected to each other by a connector assembly comprising a first connector 101 shown in FIGS. 8 and 9 and a second connector 201 that is mated with this first connector 101.

Specifically, in the first connector 101, the signal conductors 121 formed on the first side 123 (see FIG. 9) of the respective boards 120 are utilized as male type contacts, and are mated and connected with female type contacts 202 disposed in the second connector 201. The male type contacts 202 of the second connector 201 are connected to the multi-layer board 301. Moreover, the plurality of contacts 130 disposed on the second side 124 (see FIG. 9) of the respective boards 120 are connected to the multi-layer board 302. As a result, the impedance of the signal paths inside the connector assembly comprising the first connector 101 and second connector 201 can be maintained at a uniform impedance value, so that data signals can be transmitted at a high speed.

FIG. 11 shows a connector 401 in which a plurality of female contacts 425 are connected to the respective end parts of a plurality of boards 421, 422, 423 and 424, and these female contacts 425 are secured inside a housing 410. A plurality of signal conductors 421*a* and ground conductors 421*b* are formed on the surfaces of the respective boards 421, 422, 423 and 424, and the female contacts 425 are soldered to one end of each of the conductor patterns 421*a* and 421*b*. Contacts 426 that are connected to a circuit board (PCB) are disposed on the other ends of the respective conductor patterns 421*a* and 421*b*. In FIG. 11, shielding patterns 421*c* are disposed between the conductor patterns 421*a* and 421*b* to prevent crosstalk.

However, the following problems have been encountered in the conventional connector assembly shown in FIG. 10 and the connector shown in FIG. 11.

Specifically, in the connector assembly shown in FIG. 10, since the female contacts 202 disposed inside the second connector 201 have a structure in which these contacts make receiving contact or elastic contact with the signal conductors 121 (formed on the respective boards 120) used as male type contacts during mating, these female contacts are susceptible to damage during mating. Consequently, as insertion and extraction of the first connector 101 and second connector 201 are repeated, there is a high probability that damaged female contacts 202 will be generated. Accordingly, it is desirable that it be easy to replace damaged female contacts 202. However, to replace damaged female contacts 202, it is necessary to release the connection of all of the female contacts 202 with the multi-layer board 301, to remove the second connector 201 from the multi-layer board 301, and to remove the female contact 202 in question from the housing of the second connector 201. Accordingly, such replacement is difficult to accomplish.

For the connector shown in FIG. 11, replacing damaged female contacts 425, requires that the connection of the contacts 426 connected to the circuit board be released from the circuit board, that the connector 401 be removed from the circuit board, that the board to which the female contact 425 in question is attached be removed from the housing 410, and that the female contact 425 in question be removed from the board. Again, such replacement is not easily accomplished.

SUMMARY OF THE INVENTION

The present invention provides a connector assembly which allows the easy replacement of easily damaged female contacts, and which can be used in data transfer systems such as communications devices that transmit data signals at a high speed. The connector assembly comprises a first connector having a plurality of first boards which have conductors formed on the surfaces thereof, a second connector having a plurality of second boards which have conductors formed on the surfaces thereof, and a relay connector which is attached to the first connector or second connector. A plurality of female contacts having first female contact portions that contact the conductors of the first boards and second female contact portions that contact the conductors of the second boards are press-fitted in the relay connector.

DETAILED DESCRIPTION OF THE INVENTION

Figure 1:
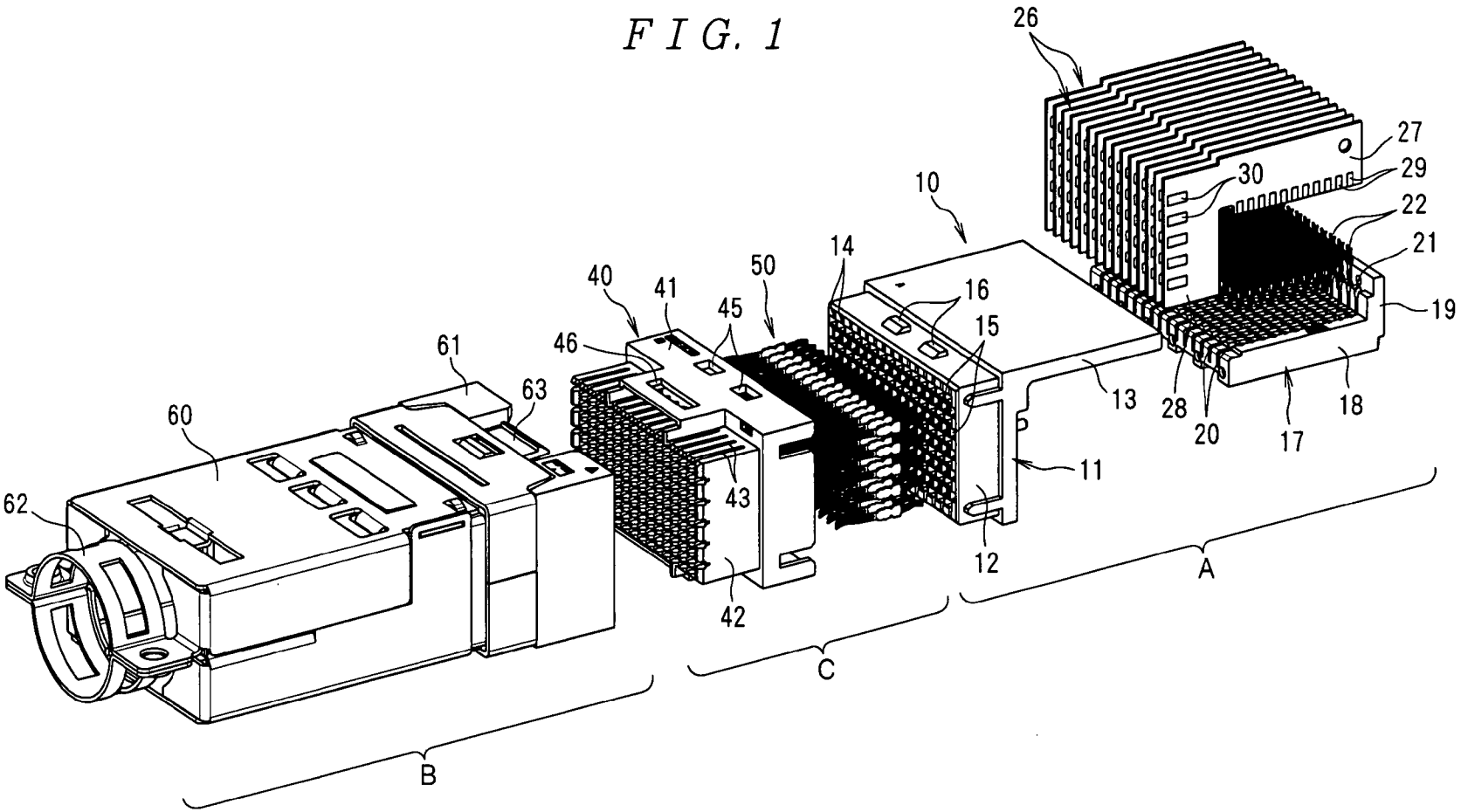
FIG. 1 is an exploded perspective view of a connector assembly according to an exemplary embodiment of the present invention.
Figure 2:
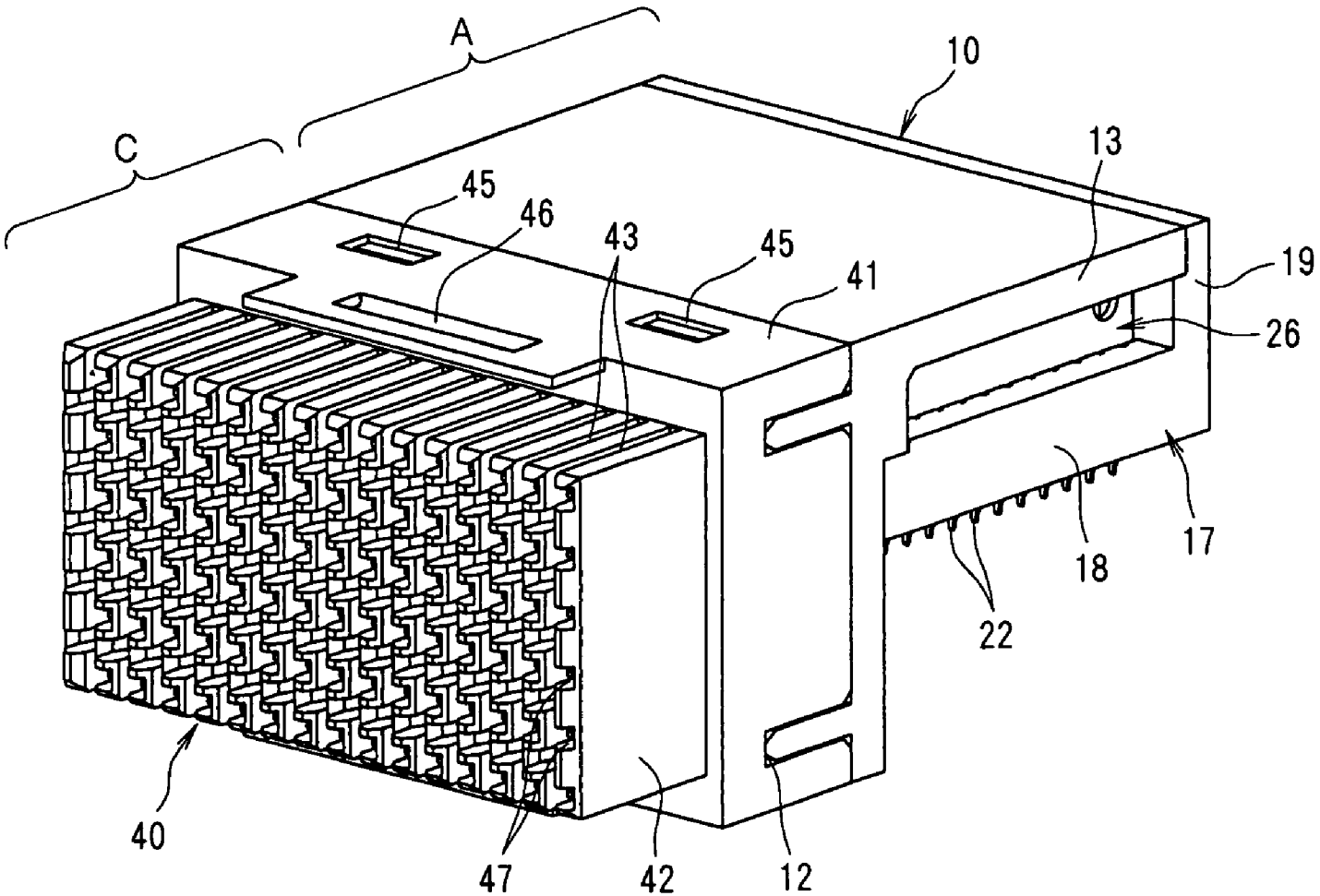
FIG. 2 is a perspective view of showing the first connector and relay connector from the connector assembly of FIG. 1, attached.
Figure 3A:
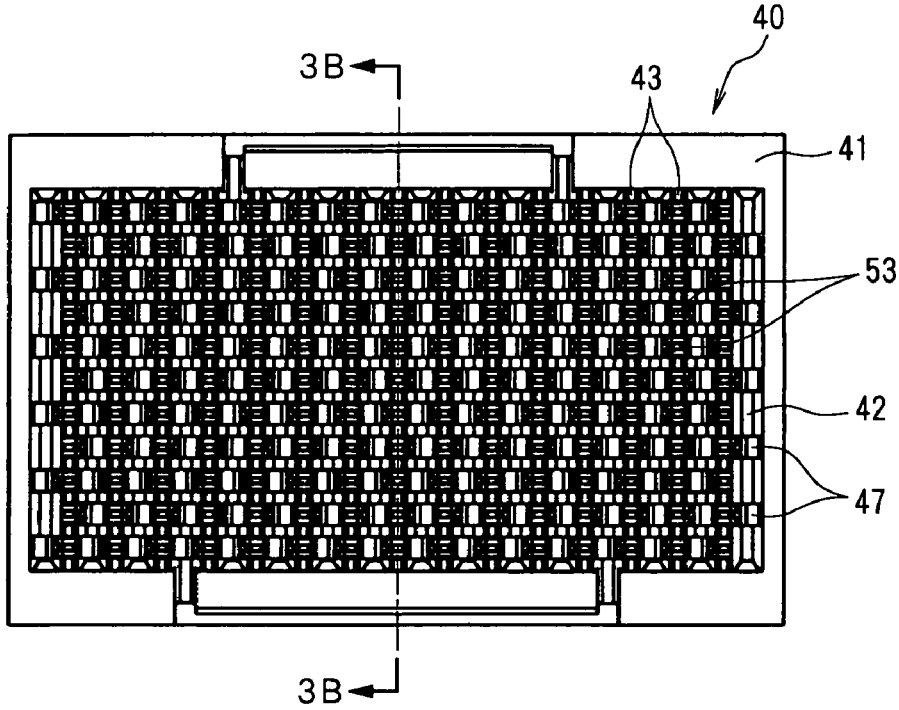
FIGS. 3(A) and 3(B) show the attached first connector and relay connector shown in FIG. 2, with FIG. 3(A) being a front view, and FIG. 3(B) being a sectional view along line 3B—3B in FIG. 3(A)
Figure 3B:
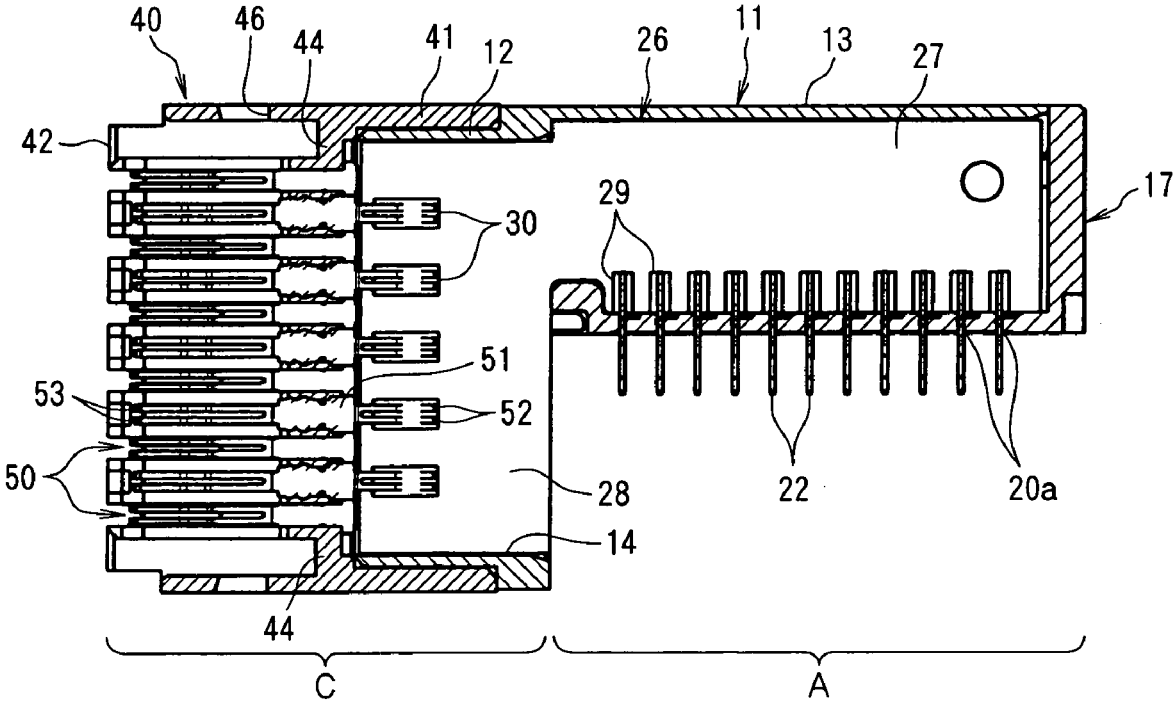
Figure 4:
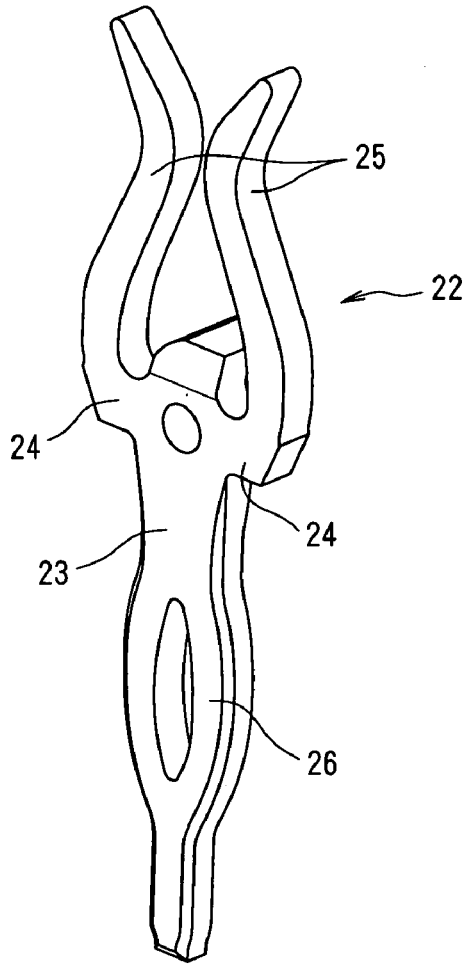
FIG. 4 is a perspective view of one of the contacts used in the first connector of FIG. 2.
Figure 5:
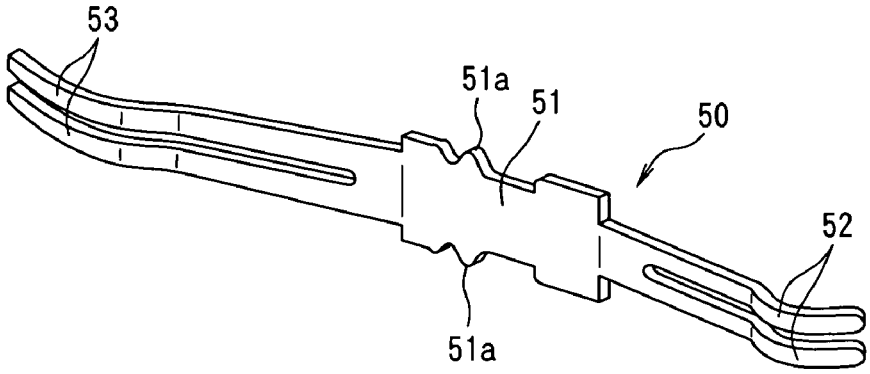
FIG. 5 is a perspective view of one of the female type contacts used in the relay connector of FIG. 2.
Figure 6A:
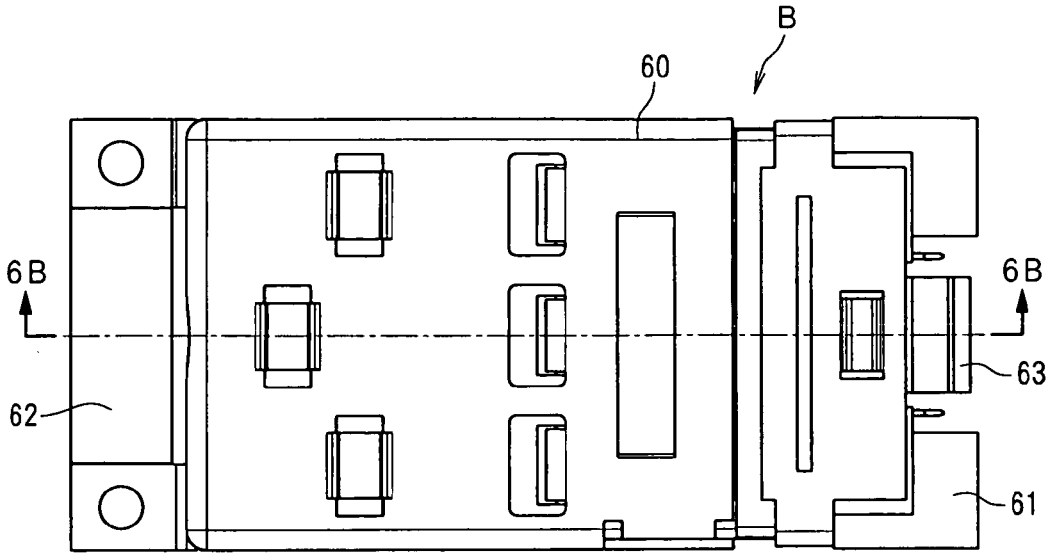
FIGS. 6(A) to (D) show the second connector o FIG. 2, with FIG. 6(A) being a plan view, FIG. 6(B) being a sectional view along line 6B—6B in FIG. 6(A), FIG. 6(C) being a left-side view, and FIG. 6(D) being a right-side view.
Figure 6B:
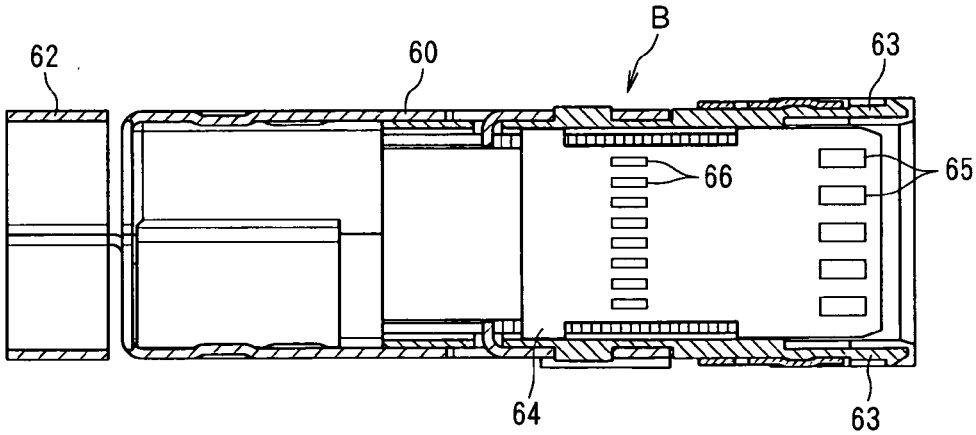
Figure 6C:
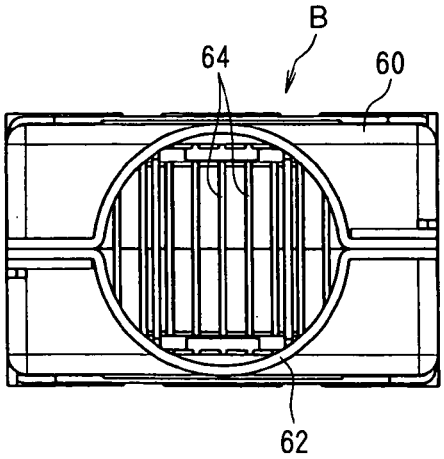
Figure 6D:
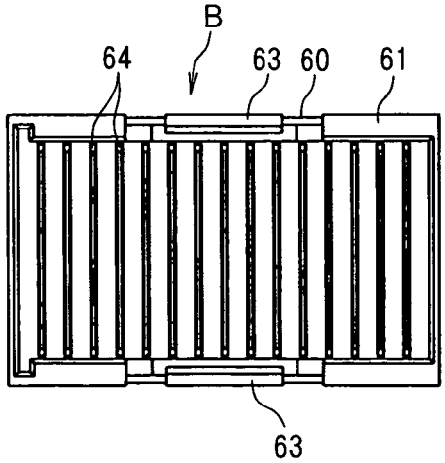
Figure 7:
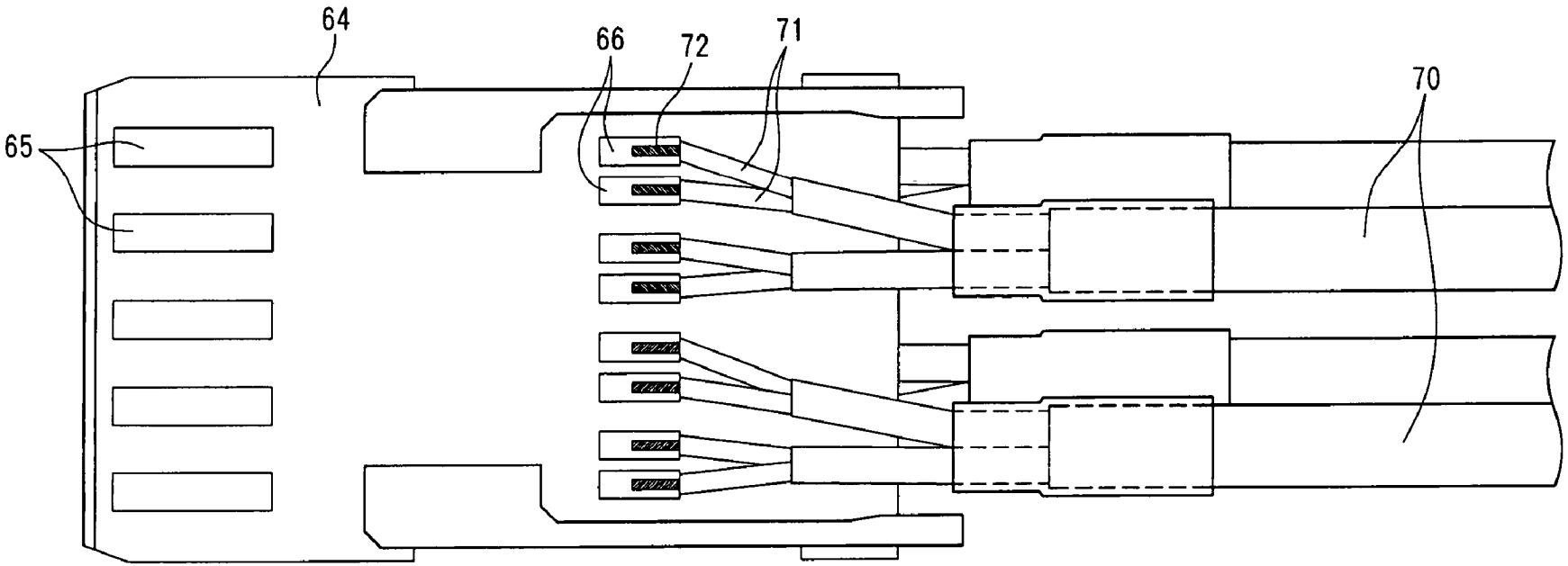
FIG. 7 is an explanatory diagram illustrating the connection of electrical wires to the second boards in the second connector.

Next, an exemplary embodiment of the present invention will be described with reference to the figures. FIG. 1 is an exploded perspective view of a connector assembly according to an exemplary embodiment of the present invention. FIG. 2 is a perspective view showing a first connector and relay connector of the connector assembly attached. FIGS. 3(A) and (B) show the attached first connector and relay connector shown in FIG. 2, with FIG. 3(A) being a front view, and FIG. 3(B) being a sectional view along line 3B—3B in FIG. 3(A). FIG. 4 is a perspective view of one of the contacts used in the first connector. FIG. 5 is a perspective view of one of the female contacts used in the relay connector. FIGS. 6(A) to 6(D) show the second connector, with FIG. 6(A) being a plan view, FIG. 6(B) being a sectional view along line 6B—6B in FIG. 6(A), FIG. 6(C) being a left-side view, and FIG. 6(D) being a right-side view. FIG. 7 is a diagram illustrating the connection of electrical wires to the second boards in the second connector.

In FIG. 1, the connector assembly is constructed from a first connector A, a second connector B, and a relay connector C.

Here, the first connector A comprises an insulating housing 10 and a plurality of first boards 26 that are supported in a row in the housing 10.

Figure 8:
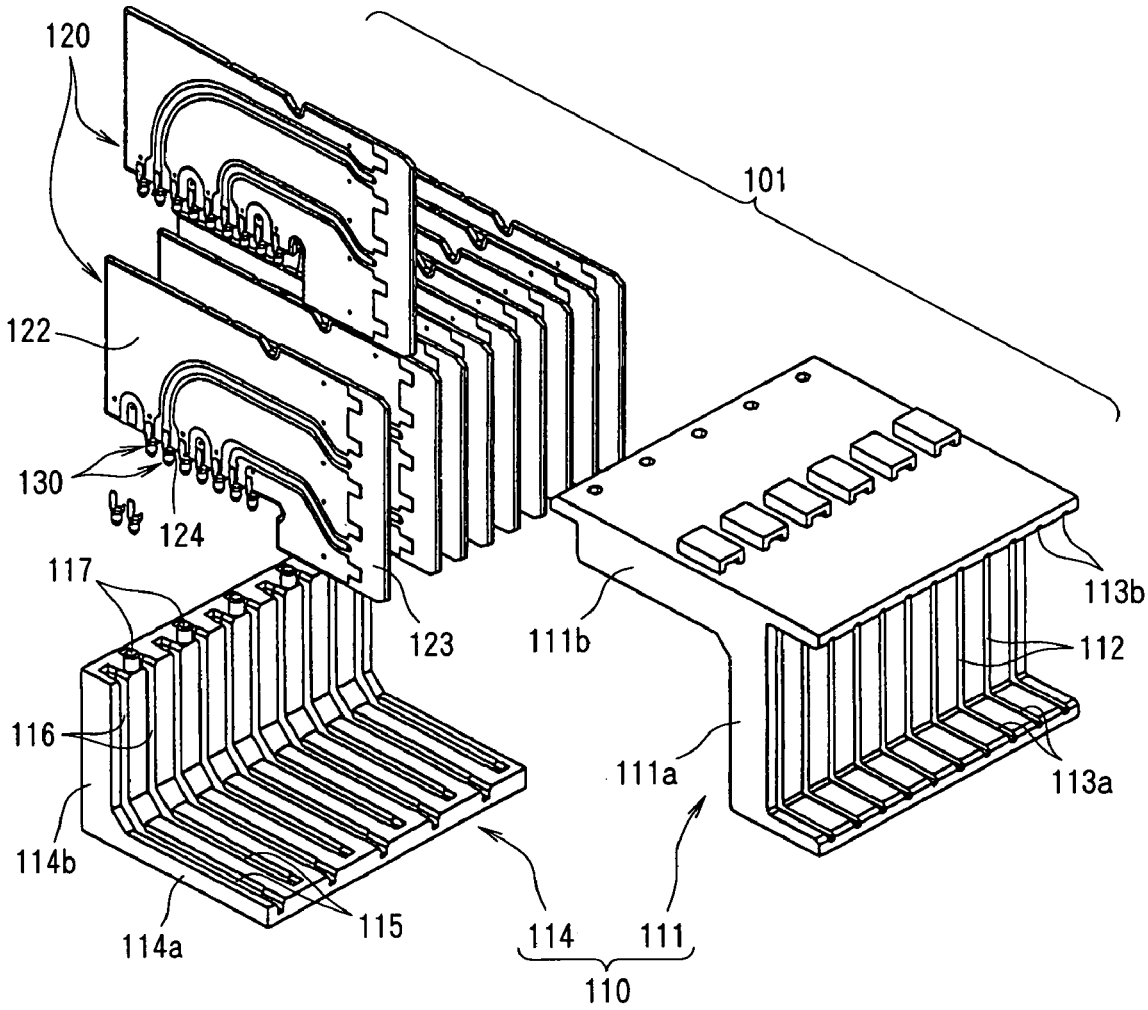
FIG. 8 is a perspective view of a conventional connector used in data transfer systems such as communications devices that transmit data signals at a high speed.
Figure 9:
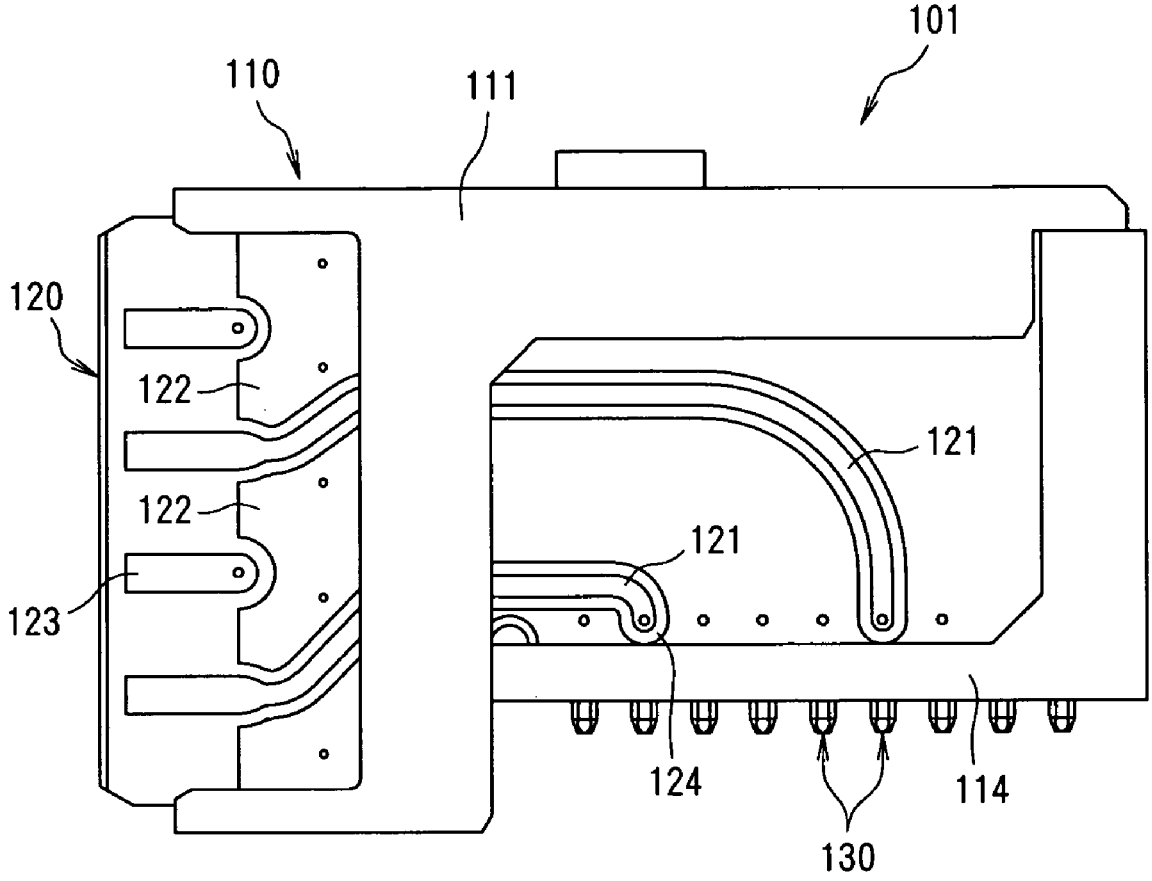
FIG. 9 is a side view of the connector shown in FIG. 8.
Figure 10:
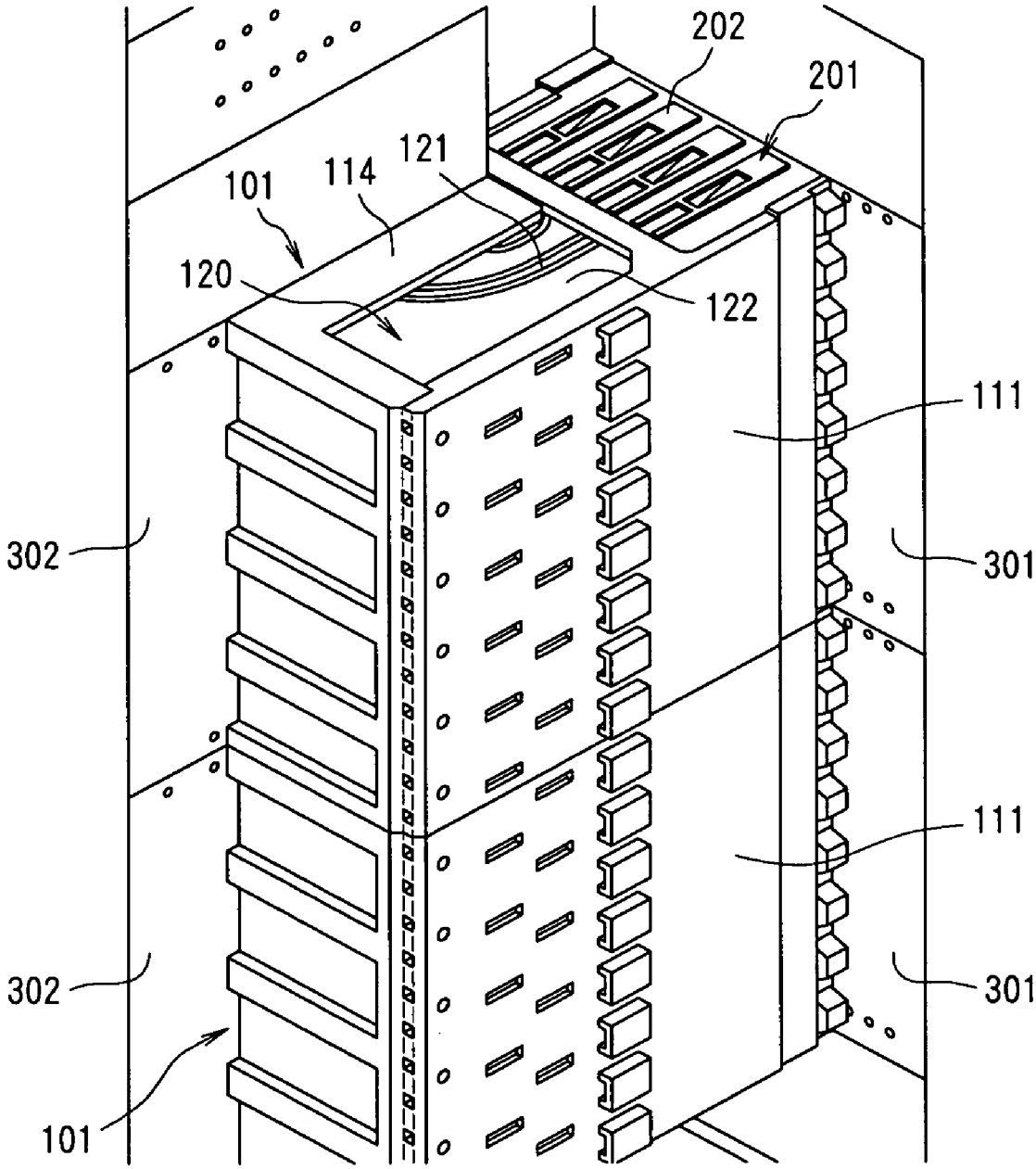
FIG. 10 is a perspective view of a conventional example of a connector assembly.
Figure 11:
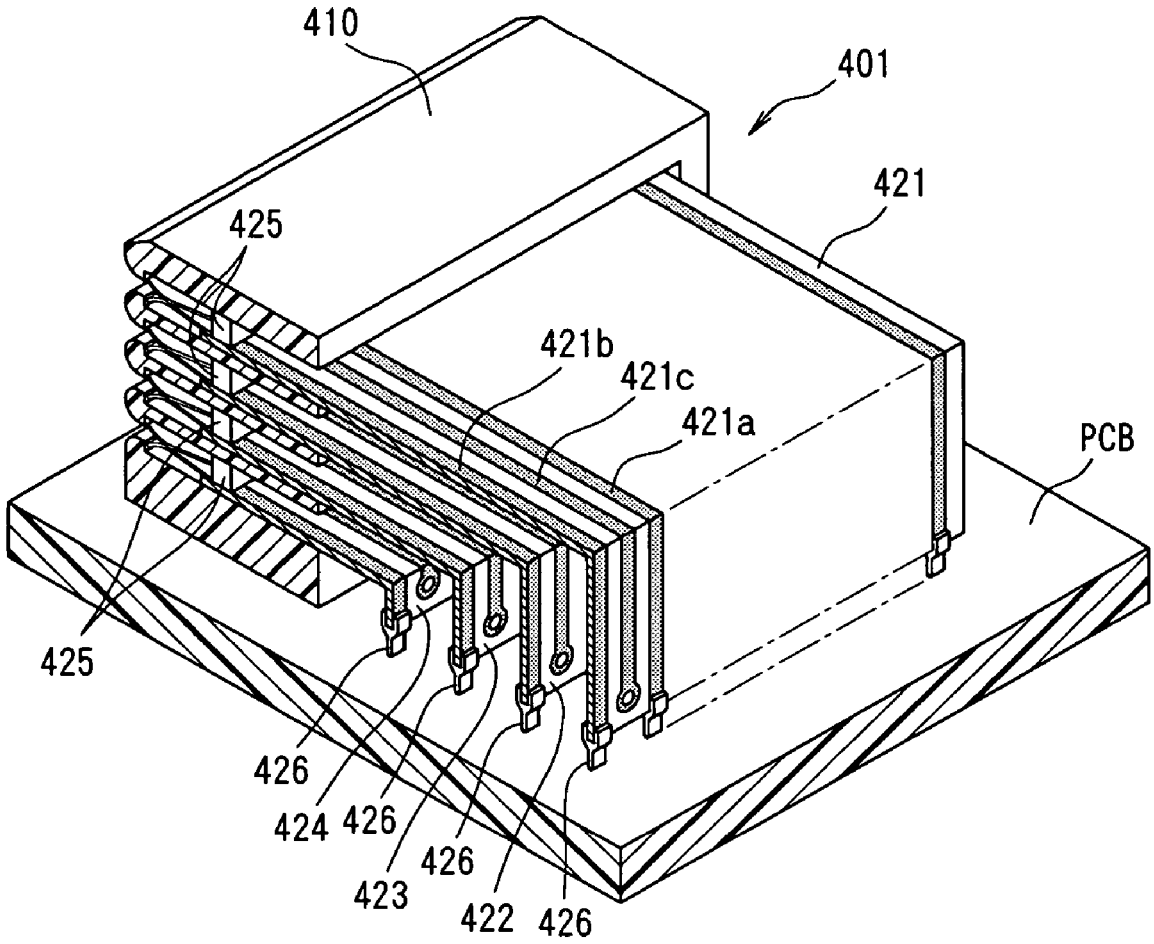
FIG. 11 is a sectional perspective view of a conventional example of a connector.

The respective first boards 26 have the same function as the boards 120 shown in FIG. 8. Each first board 26 is formed substantially in an L shape, having a mounting leg 27 and a mating leg 28. The mounting leg 27, which extends in the forward-rearward direction (the left-right direction in FIG. 1), is used for mounting the respective first board 26 on a motherboard (not shown in the figures). The mating leg 28, which extends downward from the mounting leg 27, is used for mating with the relay connector C. In an exemplary embodiment, first boards 26 are constructed from an insulating board material such as FR4, with a plurality of signal conductors (not shown in the figures) and a plurality of ground conductors (not shown in the figures) formed on the front and back surfaces of the first boards 26, such that the ground conductors surround the signal conductors with a specified distance retained between the two types of conductors. The signal conductors are terminated at one end by conductive pads 30 that are disposed on the front end of the mating legs 28, and at the other end by conductive pads 29 disposed on the lower end of the mounting legs 27. The ground conductors are terminated by conductive pads 29 disposed on the lower end of the mounting legs 27.

The housing 10 comprises a front housing portion 11 and an accommodating body 17. The front housing portion 11 comprises a mating portion 12 that extends in the vertical direction, and a top portion 13 that extends rearward from the upper end of the mating portion 12. The front housing portion 11 may be formed, for example, by molding an insulating resin. A plurality of slits 14 are formed in the mating portion 12 to receive the respective first boards 26, such that the mating legs 28 of the first boards 26 pass through the plurality of slits 14. The respective slits 14 extend in the vertical direction of the mating portion 12, and pass through the mating portion 12 in the forward-rearward direction as shown in FIG. 3(B). As is shown in FIG. 3(B), when the mating legs 28 of the first boards 26 are passed through the slits 14, the movement of the mating legs 28 of the first boards 26 in the vertical direction is restricted by the upper and lower walls of the slits 14, so that the first boards 26 are supported in the front housing portion 11. The mating legs 28 of the first boards 26 are passed through the slits 14 until the front ends of the mating legs 28 are coplanar with the front end surface of the mating portion 12 of the front part housing 11. A plurality of first recesses 15 are formed in the respective slits 14, configured to receive first elastic contact arms 52 of female contacts 50 (described later) when they are inserted into the first recesses 15. Moreover, a plurality of locking projections 16 are formed on the upper end surface of the mating portion 12.

The accommodating body 17 comprises a platform 18 that extends in the forward-rearward direction, and a vertical rear wall 19 that extends upward from the rear end of the platform 18. This accommodating body 17 may be formed, for example, by molding an insulating resin. A plurality of grooves 20 are formed in the platform 18, into which, the lower ends of the mounting legs 27 of the respective first boards 26 are inserted. A plurality of contact holes 20*a* are formed in the bottom parts of the respective grooves 20, configured to receive contacts 22 for making an electrical connection with the conductive pads 29 of the first boards 26. A plurality of grooves 21 are formed in the rear wall 19 to receive the rear ends of the mounting legs 27 of the respective first boards 26. The front housing portion 11 and accommodating body 17 are locked to each other by locking means not shown in the figures.

As is shown most clearly in FIG. 4, each of the contacts 22 comprises a base 23 which is disposed inside the corresponding contact hole 20*a* of the accommodating body 17, a pair of elastic contact arms 25 that extend upward from the upper end of the base 23 via shoulders 24, and a press-fitting portion 26 which extends downward from the base 23. These contacts 22 may be formed, for example, by stamping metal plates. The contacts 22 are configured such that when the bases 23 are disposed inside the contact holes 20*a*, the shoulders 24 are positioned on the bottom of the slits 20, restricting downward movement. The pair of elastic contact arms 25 receive and contact the conductive pads 29 of the first boards 26, and the press-fitting portions 26 are press-fitted in the motherboard when the first connector A is mounted on the motherboard.

Next, the second connector B will be described. In an exemplary embodiment of the invention, connector B comprises a metal housing 60 and a plurality of second boards 64 that are attached in a row inside the housing 60. The housing 60 comprises a mating portion 61 which has a recess configured to receive the mating portion 42 of the relay connector C, and a cable lead-out 62, disposed on the end of the housing 60 opposite from the mating portion 61. Latch arms 63 are formed on the mating portion 61.

The respective second boards 64 are constructed from an insulating board material such as FR4, and a plurality of signal conductors (not shown in the figures) and a plurality of ground conductors (not shown in the figures) are formed on the front and back surfaces of each second board 64. The signal conductors are terminated by conductive pads 65 (shown in FIG. 6B) at an end of the respective second board 64 configured to mate with the relay connector C. At the opposite end of the signal conductors, they are terminated by conductive pads 66 disposed on substantially the central portions of the second boards 64. Each of the second boards 64 is attached to the housing 60 so that the relay connector C mating end protrudes into the recess of the mating portion 61 of the housing 60.

As is shown in FIG. 7, a core wire 72 of an insulated electrical wire 71 is connected by soldering to each of the conductive pads 66 of each second board 64. Furthermore, a plurality of cables 70 each bundling a plurality of insulated electrical wires 71 are led out of the second housing B via the cable lead-out 62.

As shown in FIGS. 1, 2, 3A, and 3B, the relay connector C comprises an insulating housing 40 and a plurality of rows of female contacts 50 that are press-fitted in the housing 40.

The housing 40 comprises a first connector mating portion 41 which has a recess that receives the mating portion 12 of the first connector A, and a second connector mating portion 42 that protrudes forward (to the left in FIG. 1) from the first connector mating portion 41. The housing 40 may be formed, for example, by molding an insulating resin. Furthermore, locking holes 45 are formed in the upper end surface of the first connector mating portion 41. The locking projections 16 on the mating portion 12 of the first connector A are locked into these locking holes 45 by insertion of the first connector A into the relay connector C. Moreover, a plurality of slits 43 which receive the mating end of the second boards 64 of the second connector B are formed in the second connector mating portion 42. Each of the slits 43 extends in the vertical direction of the second connector mating portion 42 as shown in FIGS. 1 through 3. A latch arm anchoring hole 46 is formed in the top of the second connector mating portion 42 to anchor one of the latch arms 63 of the second connector B.

As is shown in FIG. 3(B) and FIG. 5, each female contact 50 comprises a press-fitting base 51 which is press-fitted in the bottom wall of the recess in the first connector mating portion 41 of the housing 40, a pair of first elastic contact arms (first female contact) 52 which extend from the press-fitting base 51 into the interior of the recess in the first connector mating portion 41, and a pair of second elastic contact arms (second female contact) 53 which extend from the press-fitting base 51 into the interior of a second contact recess 47 formed in the corresponding slit 43 of the second connector mating portion 42. The female contacts 50 may each be formed, for example, by stamping and forming a metal plate. A plurality of barbs 51*a* are formed in the upper and lower edges of the press-fitting base 51, and are anchored by press-fitting in the lower wall of the recess of the first connector mating portion 41. Furthermore, the first elastic contact arms 52 are arranged so that these arms elastically contact the conductive pads 30 in which the signal conductor patterns of the first boards 26 are terminated when the relay connector C is mated with the first connector A. Moreover, the second elastic contact arms 53 are arranged so that these arms elastically contact the conductive pads 65 in which the signal conductor patterns of the second boards 64 are terminated when the second connector B is mated with the relay connector C.

As is shown in FIGS. 2 and 3, the relay connector C is mated with the first connector A and attached to the first connector A before the second connector B is mated. When the relay connector C and first connector A are to be attached, the mating portion 12 of the first connector A is inserted into the recess of the first connector mating portion 41 of the relay connector C, and the locking projections 16 of the first connector A are locked in the locking holes 45 of the relay connector C. When the relay connector C and first connector A are mated, the first elastic contact arms 52 of the female contacts 50 of the relay connector C elastically contact the conductive pads 30 of the first boards 26, so that the female contacts 50 are electrically connected with the contacts 22 and motherboard via the signal conductors on the first boards 26.

Next, the second connector B is mated with the relay connector C after the relay connector C has been attached to the first connector A. As a result, the connector assembly is completed. To mate the second connector B and relay connector C, the second connector mating portion 42 of the relay connector C is inserted into the recess of the mating portion 61 of the second connector B, and the latch arms 63 of the second connector B are anchored in the latch arm anchoring holes 46 of the relay connector C. When the second connector B and relay connector C are mated, the conductive pads 65 of the second boards 64 of the second connector B contact the second elastic contact arms 53 of the female contacts 50 of the relay connector C. As a result, the insulated electrical wires 71 are electrically connected with the female contacts 50 of the relay connector C via the signal conductors on the second boards 64, and are further electrically connected with the contacts 22 and motherboard via the signal conductors on the first boards 26 of the first connector A.

In the exemplary connector assembly described above, the conductive pads 30 (in which the signal conductors of the respective first boards 26 are terminated) and the conductive pads 65 (in which the signal conductors of the respective second boards 64 are terminated) are utilized as male contacts, contacting the female contacts 50 of the relay connector C. Furthermore, the conductive pads 29 (in which the signal conductors of the respective first boards 26 are terminated) are connected to the motherboard via the contacts 22, while the insulated electrical wires 71 are connected by soldering to the conductive pads 66 in which the signal conductors of the respective second boards 64 are terminated. As a result, the impedance of the signal paths inside the connector assembly can be maintained at a uniform value, so that data signals can be transmitted at a high speed.

Furthermore, in this connector assembly, the second connector B is mated with the relay connector C in a state in which the relay connector C has already been attached to the first connector A. Accordingly, the second elastic contact arms 53 of the female contacts 50 (disposed in the relay connector C) that are contacted by the conductive pads 65 of the second connector B are easily damaged. In cases where the second elastic contact arms 53 of the female contacts 50 are damaged, or in cases where the first elastic contact arms 52 of the female contacts 50 are damaged, the corresponding female contacts 50 are easily replaced by the following method.

First, after the second connector B is removed from the relay connector C, the relay connector C is removed from the first connector A. Then, the corresponding female contact 50 is removed from the housing 40, and a new female contact 50 is press-fitted into the housing 40. Then, it is necessary merely to mate the relay connector C with the first connector A, and then to mate the second connector B with the relay connector C. Accordingly, in the connector assembly of the present embodiment, there is no need to remove the relay connector C from the motherboard, etc., when female contacts 50 are replaced, and damaged female contacts 50 can be replaced by the simple method described above.

An embodiment of the present invention has been described above. However, the present invention is not limited to this embodiment; various alterations or modifications are possible.

For example, the connector assembly is arranged so that the relay connector C is first attached to the first connector A; however, it would also be possible to attach the relay connector C to the second connector B, and then to mate the first connector A with the relay connector C.

Furthermore, the first female contacts and second female contacts of the female contact 50 are respectively constructed from elastic contact arms 52 that elastically contact the conductive pads 30 formed on the surfaces of the first boards 26 and elastic contact arms 53 that elastically contact the conductive pads 65 formed on the surfaces of the second boards 64; however, it would also be possible to devise these contact parts so that the parts receive the ends of the first boards 26 or second boards 64 and contact the conductive pads 30 or 65 on the surfaces of the boards.

What is claimed is:

1. A connector assembly comprising:

a first connector having a plurality of first boards with conductors formed on the surfaces thereof;

a second connector having a plurality of second boards with conductors formed on the surfaces thereof; and a relay connector which is attached to the first connector or second connector, and in which a plurality of female contacts are press-fitted, the female contacts having first female contact portions that contact the conductors of the first boards and second female contact portions that contact the conductors of the second boards.

2. The connector assembly according to claim 1, wherein the first connector is mounted on a motherboard.

3. The connector assembly according to claim 2, wherein a plurality of electrical wires are terminated to the conductors on the second boards of the second connector.

4. The connector assembly according to claim 1, wherein the relay connector comprises an insulating housing having a first connector mating portion with a recess that receives a corresponding mating portion of the first connector and a second connector mating portion that protrudes from the first connector mating portion.

5. The connector assembly according to claim 4, wherein the plurality of second boards each have a mating end and the second connector mating portion of the relay connector has a plurality of slits configured to receive the mating end of the second boards.

6. The connector assembly according to claim 4, wherein each female contact comprises a press-fitting base configured to be press-fitted in the recess in the first connector mating portion, a pair of first elastic contact arms extending from the press-fitting base into the recess in the first connector mating portion, and a pair of second elastic contact arms extending from the press-fitting base into corresponding slit in the second connector mating portion.

7. The connector assembly according to claim 6, wherein the first elastic contact arms are arranged to elastically contact conductive pads on the conductors of the first boards when the first connector is mated with the relay connector.

8. The connector assembly according to claim 7, wherein the second elastic contact arms are arranged to elastically contact the conductive pads on the signal conductors of the second boards when the second connector is mated with the relay connector.

9. A relay connector for mating a first connector and a second connector each having a plurality of boards with conductors on surfaces thereof terminating in conductive pads configured to be utilized as male contacts; the relay connector having a plurality of press-fitted female contacts secured therein, the female contacts having first female contact portions that contact the conductive pads of the first boards and second female contact portions that contact the conductive pads of the second boards.

10. The relay connector according to claim 9, further comprising an insulating housing having a first connector mating portion with a recess that receives a corresponding mating portion of the first connector and a second connector mating portion that protrudes from the first connector mating portion.

11. The relay connector according to claim 10, wherein the second connector mating portion has a plurality of slits configured to receive a mating end of the boards of the second connector.

12. The relay connector according to claim 10, wherein each female contact comprises a press-fitting base configured to be press-fitted in the recess in the first connector mating portion, a pair of first elastic contact arms extending from the press-fitting base into the recess in the first connector mating portion, and a pair of second elastic contact arms extending from the press-fitting base into a corresponding slit in the second connector mating portion.

13. The relay connector according to claim 12, wherein the first elastic contact arms are arranged to elastically contact conductive pads on the conductors of the boards of the first connector when the first connector is mated wit the relay connector.

14. The connector assembly according to claim 12, wherein the second elastic contact arms are arranged to elastically contact conductive pads on the conductors of the boards of the second connector when the second connector is mated with the relay connector.

* * * * *

UNITED STATES PATENT AND TRADEMARK OFFICE

CERTIFICATE OF CORRECTION

PATENT NO. : 7,044,793 B2
APPLICATION NO. : 10/847039
DATED : May 16, 2006
INVENTOR(S) : Eiichiro Takemasa It is certified that error appears in the above-identified patent and that said Letters Patent is hereby corrected as shown below:

In column 9, line 6, "connector is mated wit the" should read --connector is mated with the--.

Signed and Sealed this

Seventeenth Day of October, 2006

JON W. DUDAS
*Director of the United States Patent and Trademark Office*

UNITED STATES PATENT AND TRADEMARK OFFICE

CERTIFICATE OF CORRECTION

PATENT NO. : 7,044,793 B2
APPLICATION NO. : 10/847039
DATED : May 16, 2006
INVENTOR(S) : Eiichiro Takemasa It is certified that error appears in the above-identified patent and that said Letters Patent is hereby corrected as shown below:

In column 9, line 6, "connector is mated wit the" should read --connector is mated with the --.

Signed and Sealed this

Thirty-first Day of October, 2006

JON W. DUDAS
*Director of the United States Patent and Trademark Office*